US006740016B1

(12) United States Patent
Lee

(10) Patent No.: US 6,740,016 B1
(45) Date of Patent: May 25, 2004

(54) LEG EXERCISER WITH A MASSAGING FUNCTION

(76) Inventor: Chin Tsun Lee, No. 32, Lane 6, Kuokuang 7$^{th}$ St., Yung Kang City, Tainan Hsien (TW)

( * ) Notice: Subject to any disclaimer, the term of this patent is extended or adjusted under 35 U.S.C. 154(b) by 0 days.

(21) Appl. No.: 10/405,349

(22) Filed: Mar. 31, 2003

(51) Int. Cl.$^{7}$ ..... A63B 22/16

(52) U.S. Cl. ..... 482/146; 482/79; 482/80; 482/147; 482/907; 601/98; 601/84; 601/86; 601/26; 601/31; 601/92; 128/87

(58) Field of Search ..... 482/80, 79, 907, 482/147, 146, 148; 601/98, 84, 86, 26, 31, 79, 92; 128/57

(56) References Cited

U.S. PATENT DOCUMENTS 3,083,709 A * 4/1963 Lengsfeld ..... 128/57
5,328,443 A * 7/1994 Lee ..... 601/92
5,372,563 A * 12/1994 Chien-Nan ..... 482/79
5,489,257 A * 2/1996 Li ..... 601/48

* cited by examiner

*Primary Examiner*—Nicholas D. Lucchesi
*Assistant Examiner*—L Amerson
(74) *Attorney, Agent, or Firm*—Charles E. Baxley

(57) ABSTRACT

A leg exerciser includes a casing having a slot in a top thereof, a transmission mechanism mounted in the casing, a legrest, and at least one massage rod. The transmission mechanism includes a motor and a movable block extending through the slot of the casing. The movable block moves reciprocatingly along the slot of the casing when the motor is turned on. The legrest is fixed to the movable block to move therewith. The legrest has two recessed portions for supporting a user's legs. The massage rod is attached to the movable block to move therewith and includes at least one massage portion for providing a massaging function. At least one wheel is mounted to the massage rod and in rolling contact with the casing.

6 Claims, 7 Drawing Sheets

LEG EXERCISER WITH A MASSAGING FUNCTION

BACKGROUND OF THE INVENTION

1. Field of the Invention

The present invention relates to a leg exerciser with a massaging function. In particular, the present invention relates to a recumbent leg exerciser with a massaging function.

2. Description of the Related Art

A typical recumbent leg exerciser includes a legrest that moves reciprocatingly. The legs and a waist area of a user are exercised when the legs of the user are on the legrest. However, the recumbent leg exerciser could not provide a massage function.

SUMMARY OF THE INVENTION

An object of the present invention is to provide a recumbent leg exerciser that provides a massage function while exercising the legs of the user.

A leg exerciser in accordance with the present invention includes a casing having a slot in a top thereof, a transmission mechanism mounted in the casing, a legrest, and at least one massage rod. The transmission mechanism includes a motor and a movable block extending through the slot of the casing. The movable block moves reciprocatingly along the slot of the casing when the motor is turned on. The legrest is fixed to the movable block to move therewith. The legrest has two recessed portions for supporting a user's legs. The massage rod is attached to the movable block to move therewith and includes at least one massage portion for providing a massaging function. At least one wheel is mounted to the massage rod and in rolling contact with the casing.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
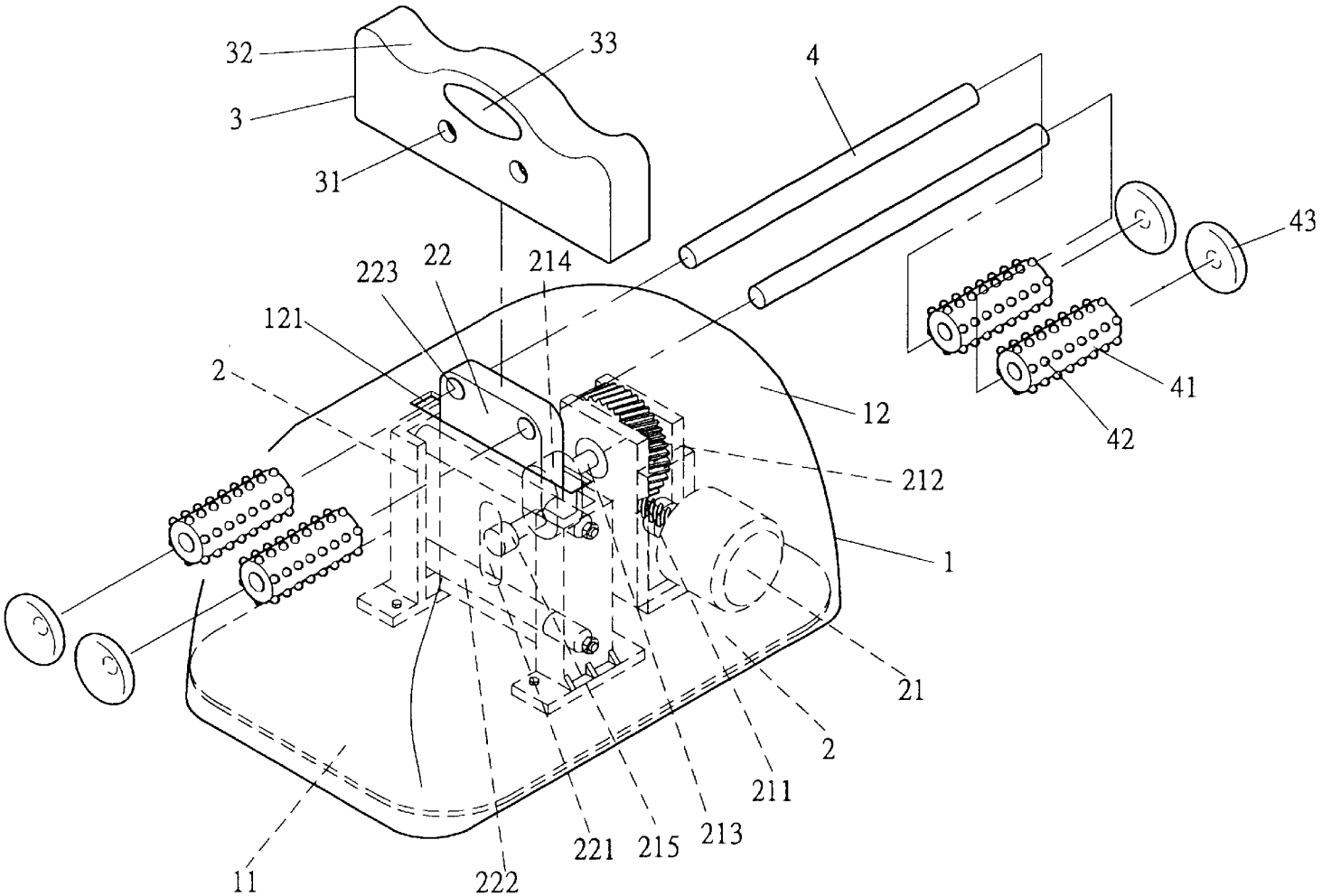
FIG. 1 is an exploded perspective view of a recumbent leg exerciser in accordance with the present invention.
Figure 2:
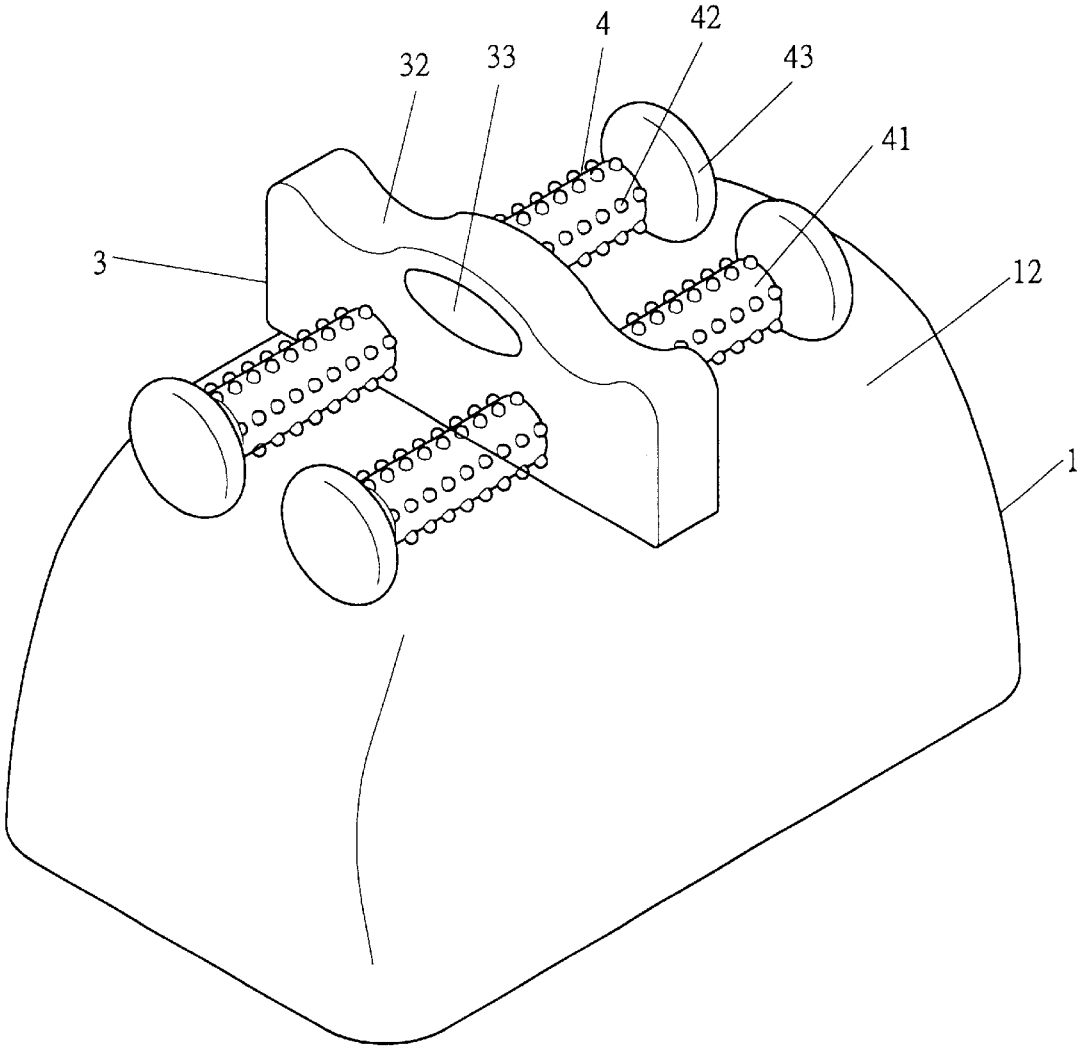
FIG. 2 is a perspective view of the recumbent leg exerciser in accordance with the present invention.

Referring to FIG. 1, a recumbent leg exerciser in accordance with the present invention generally comprises a casing 1, a transmission mechanism 2, a legrest 3, and at least one massage rod 4 (two in this embodiment). The casing 1 includes a base 11 on which the transmission mechanism 2 is mounted and an upper casing 12 having a slot 121 in a top thereof.

The transmission mechanism 2 includes a motor 21 fixed on the base 11 and a movable block 22. The transmission mechanism 2 may include a governor (not shown) to adjust the speed of the motor 21 and the movable block 22. In this embodiment, the motor 21 includes an output shaft with a worm 211 on a front end thereof. The worm 211 is connected to a reduction worm gear 212 mounted to an axle 213 on which an eccentric wheel 214 is mounted. The eccentric wheel 214 includes an actuating rod 215, and the movable block 22 has a slot 221 through which the actuating rod 215 extends. An axle 222 is connected to the movable block 22 for deciding a moving direction of the movable block 22.

When the motor 21 turns, the worm gear 212 is turned by the worm 211, which, in turn, drives the axle 213 and the eccentric wheel 214 to turn. The movable block 22 is moved reciprocatingly by the eccentric wheel 214. The worm gear 212 is designed to provide a reduction effect and provides a torque for transmission. The movable block 22 includes holes 223 for connecting with the legrest 3 and the massage rods 4.

The legrest 3 includes two holes 31 through which two massage rods 4 extend for connection with the top of the movable block 22. The legrest 3 has two recessed portions 32 for supporting the calves of the user. Further, the legrest 3 includes a grasp portion 33.

Each massage rod 4 is extended through an associated hole 223 in the top of the movable block 22 and an associated hole 31 of the legrest 3, thereby connecting the legrest 3 to the movable block 22. At least one message portion 41 (two in this embodiment) is provided on each massage rod 4 and has a plurality of protrusions 42 for providing a massaging effect. Further, at least one wheel 43 (two in this embodiment) is mounted to each massage rod 4 and is in rolling contact with the upper casing 12.

Figure 3:
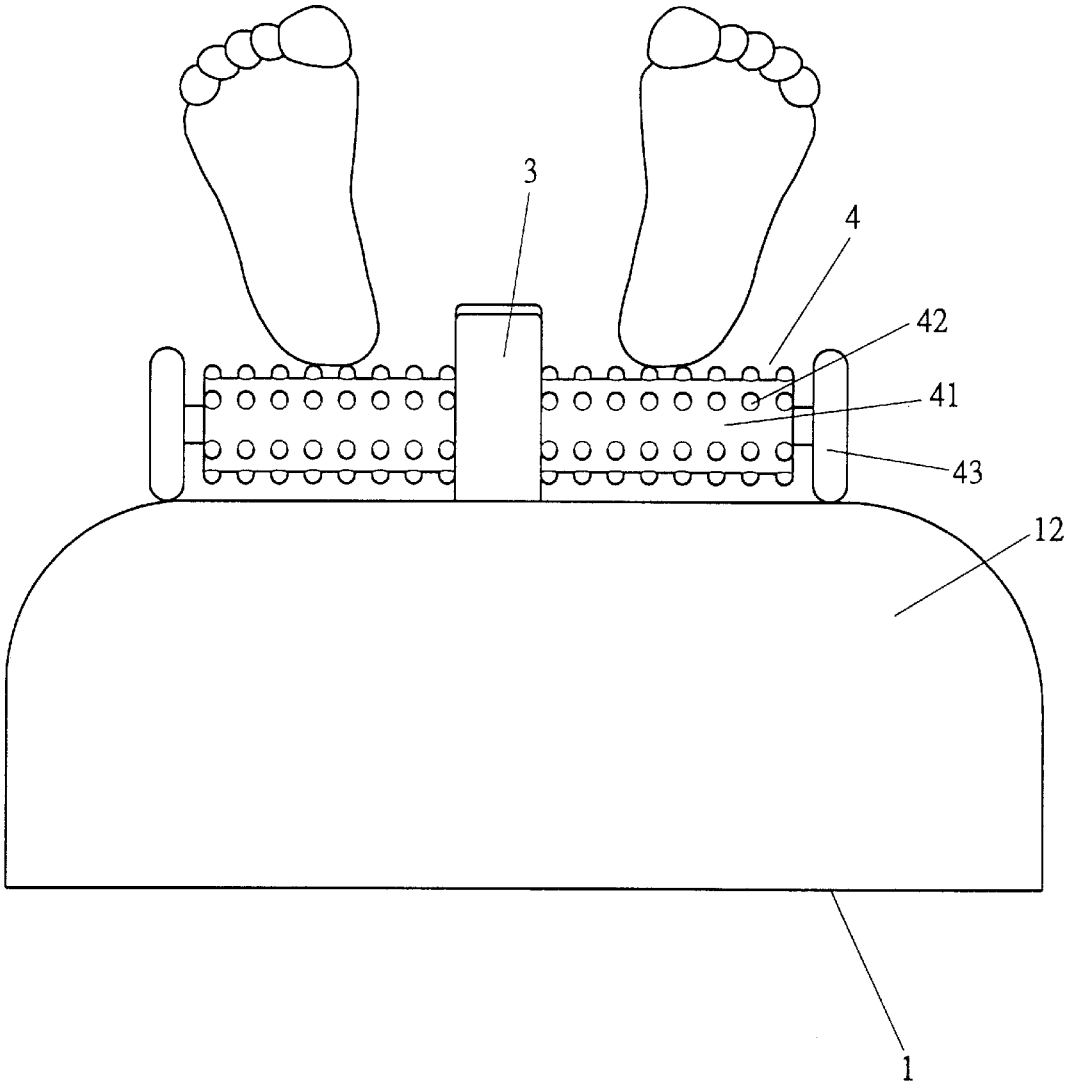
FIG. 3 is an elevational view illustrating use of the recumbent leg exerciser in accordance with the present invention.
Figure 4:
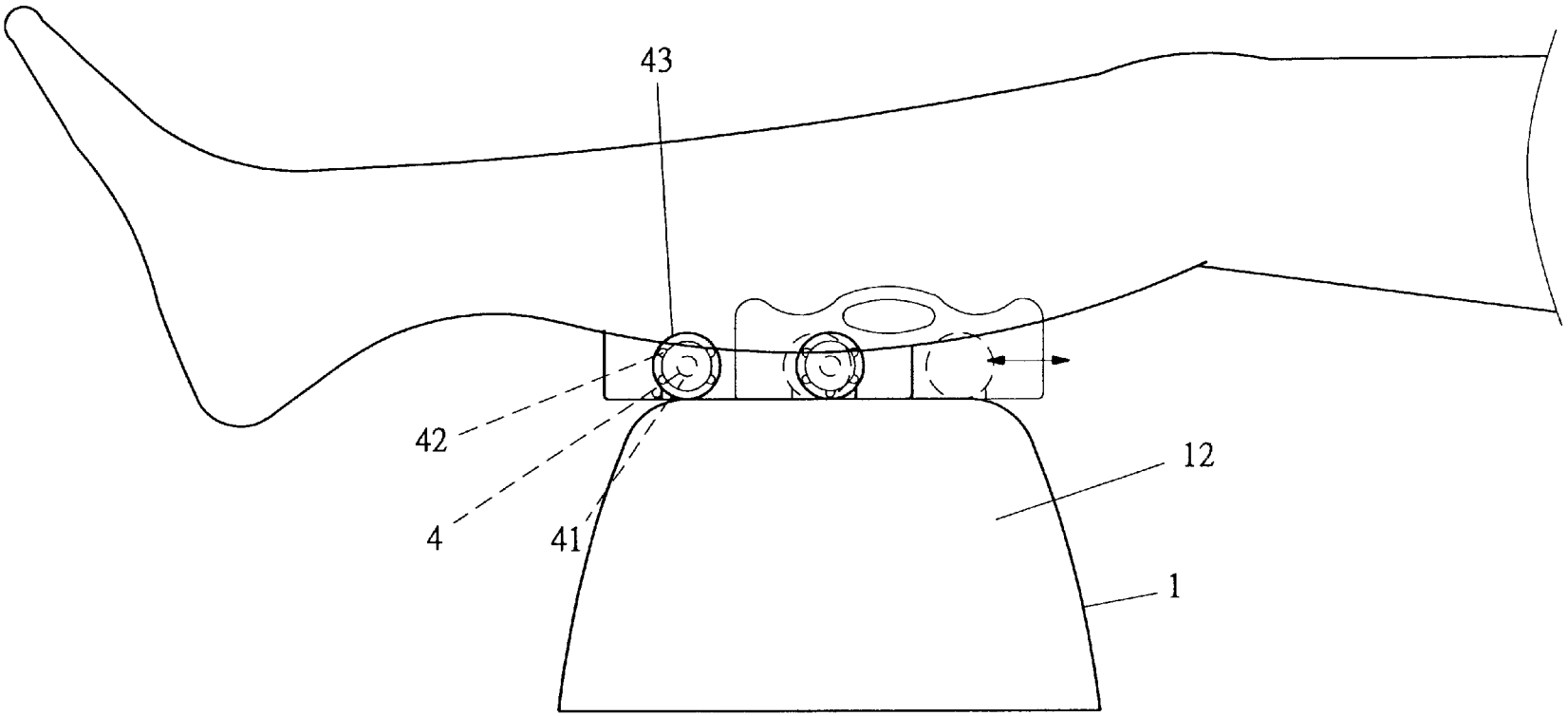
FIG. 4 is a side view of the recumbent leg exerciser in FIG. 3.

In use, as illustrated in FIGS. 3 and 4, the user may lie down with his or her calves resting on the massage portions 41 of the massage rods 4. The calves of the user are massaged when the movable blocks 22 moves reciprocatingly along a direction indicated by the double arrows in FIG. 4. The wheels 43 roll on the upper casing 12 and thus provide improved support and prevent bending of the massage rods 4 under the weight of the user's legs.

Figure 5:
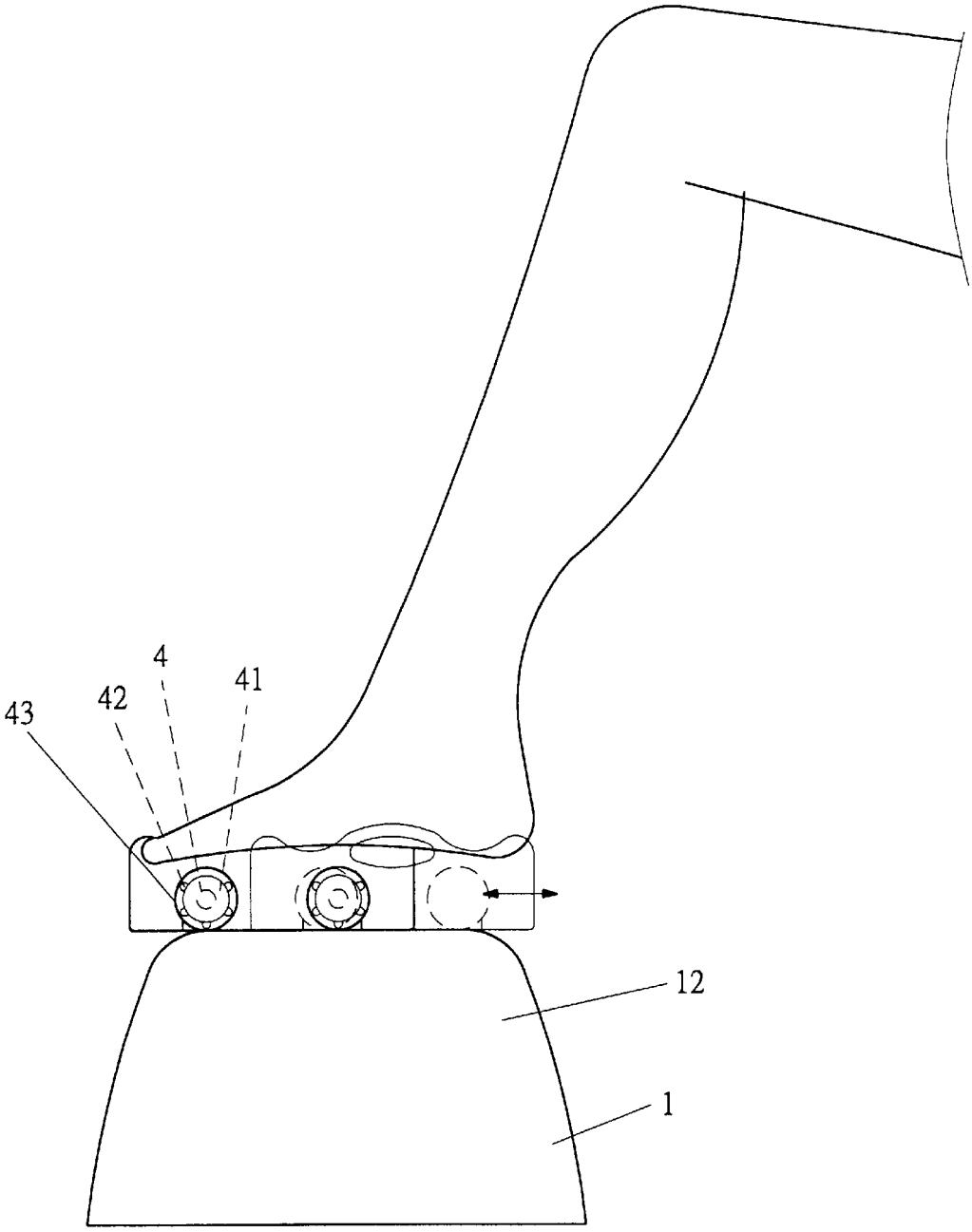
FIG. 5 is a view illustrating another use of the recumbent leg exerciser in accordance with the present invention.

FIG. 5 illustrates another use of the recumbent leg exerciser, in which the user may place his or her foot on the massage portions 41 of the massage rods 4. Thus, the protrusions 42 of the reciprocating massage rods 4 massage the user's foot that is in contact with the massage portions 41.

Figure 6:
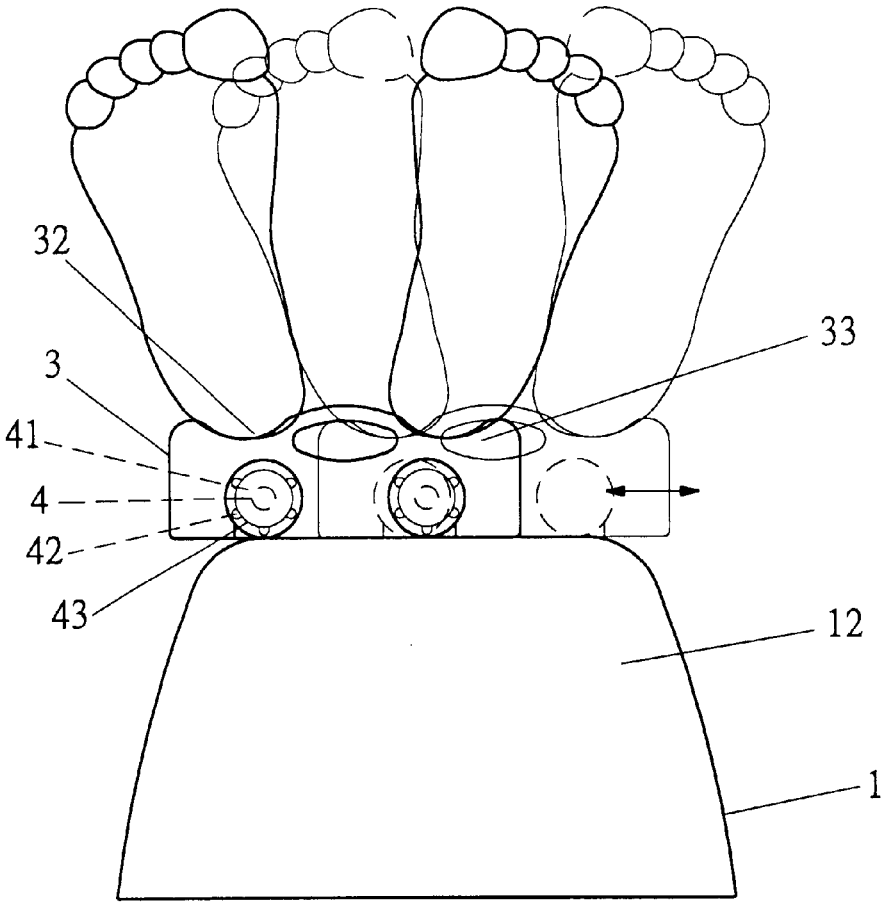
FIG. 6 is a view illustrating still a further use of the recumbent leg exerciser in accordance with the present invention.

FIG. 6 illustrates a further use of the recumbent leg exerciser, in which the casing 1 is turned through 90 degrees, and the user's legs are supported by the recessed portions 32 of the legrest 3. Thus, the user's legs are exercised when the motor 21 is turned on to activate the movable block 22. The grasp portion 33 allows easy carriage of the recumbent leg exerciser.

Figure 7:
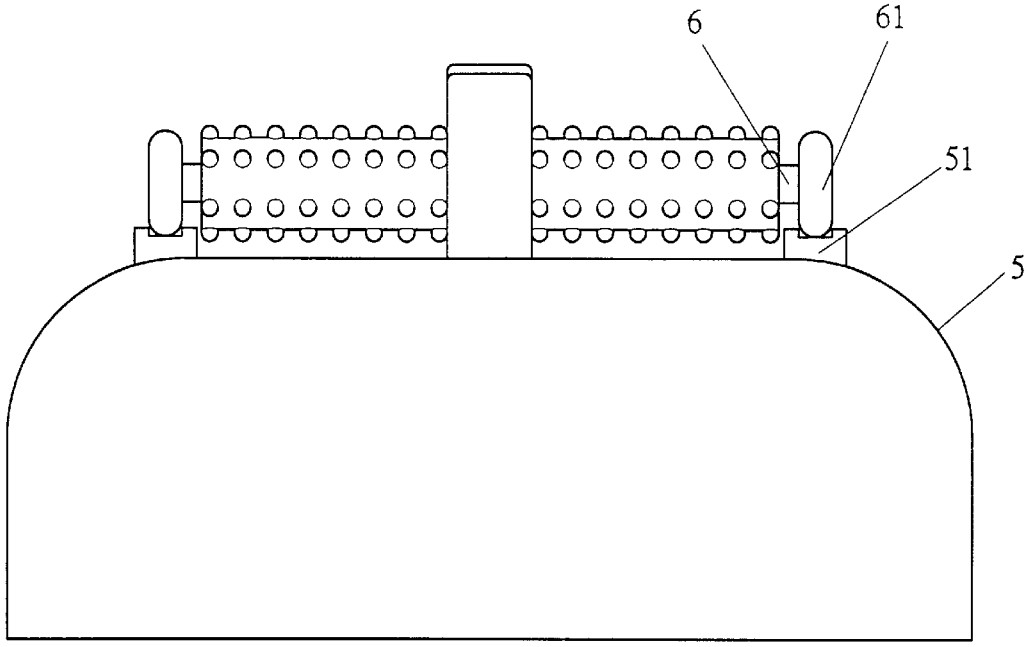
FIG. 7 is a view illustrating a modified embodiment of the recumbent leg exerciser in accordance with the present invention.

FIG. 7 illustrates a modified embodiment of the invention, wherein a pair of tracks 51 is mounted on the upper casing 12 for guiding the wheels (now designated by 61) of the massage rods (now designated by 6). The supporting stability is further improved.

Although the leg exerciser is described as a recumbent one, it is, nevertheless, noted that the leg exerciser can be used when the user is not lying down.

Although the invention has been explained in relation to its preferred embodiment, it is to be understood that many other possible modifications and variations can be made without departing from the scope of the invention as hereinafter claimed.

What is claimed is:

1. A leg exerciser comprising:

a casing having a slot in a top thereof;

a transmission mechanism mounted in the casing and including a motor and a movable block extending through the slot of the casing, the movable block moving reciprocatingly along the slot of the casing when the motor is turned on;

a legrest fixed to the movable block to move therewith, the legrest having two recessed portions for supporting a user's legs; and at least one massage rod attached to the movable block to move therewith, said at least one massage rod including at least one massage portion for providing a massaging function, at least one wheel being mounted to said at least one massage rod and in rolling contact with the casing.

2. The leg exerciser as claimed in claim 1, wherein the legrest further has a grasp portion allowing carriage of the leg exerciser.

3. The leg exerciser as claimed in claim 1, further including at least one track for receiving and guiding said at least one wheel.

4. A leg exerciser comprising:

a casing having a slot in a top thereof;

a transmission mechanism mounted in the casing and including a motor and a movable block extending through the slot of the casing, the movable block moving reciprocatingly along the slot of the casing when the motor is turned on, the movable block having two holes;

a legrest fixed to the movable block to move therewith, the legrest having two recessed portions for supporting a user's legs, the legrest further having two holes respectively aligned with the holes of the movable block; and two massage rods respectively extending through the holes of the legrest and the holes of the movable block to move therewith, each said massage rod including two massage portions for providing a massaging function, two wheels being mounted to each said massage rod and in rolling contact with the casing.

5. The leg exerciser as claimed in claim 4, wherein the legrest further has a grasp portion allowing carriage of the leg exerciser.

6. The leg exerciser as claimed in claim 5, further including two tracks for respectively receiving and guiding the wheels.

* * * * *